United States Patent [19]

Cornforth

[11] 4,056,861

[45] Nov. 8, 1977

[54] BUOYANT LIFE-SAVING DEVICE

[76] Inventor: James L. Cornforth, 728 Wayne St., Jackson, Mich. 49201

[21] Appl. No.: 747,101

[22] Filed: Dec. 3, 1976

Related U.S. Application Data

[63] Continuation of Ser. No. 631,510, Nov. 13, 1975, abandoned.

[51] Int. Cl.[2] ..... B63C 9/00

[52] U.S. Cl. ..... 9/14

[58] Field of Search ..... 9/14, 311, 329, 340, 9/301, 312, 336; 272/1 B

[56] References Cited

U.S. PATENT DOCUMENTS 579,548 3/1897 Pierce ..... 9/9

3,353,197 11/1967 Frieder et al. ..... 9/311

FOREIGN PATENT DOCUMENTS 18,019 of 1908 United Kingdom ..... 9/311

*Primary Examiner*—Trygve M. Blix
*Assistant Examiner*—Sherman D. Basinger
*Attorney, Agent, or Firm*—Beaman & Beaman

[57] ABSTRACT

A life-saving device adapted to be thrown to swimmers requiring aid consisting of a buoyant member loosely confined within a net-like web. The web is preferably buoyant and the opening in the web permits ready grasping thereof by the swimmer and the web also facilitates the device being accurately thrown considerable distances with safety.

6 Claims, 4 Drawing Figures

FIG. 1
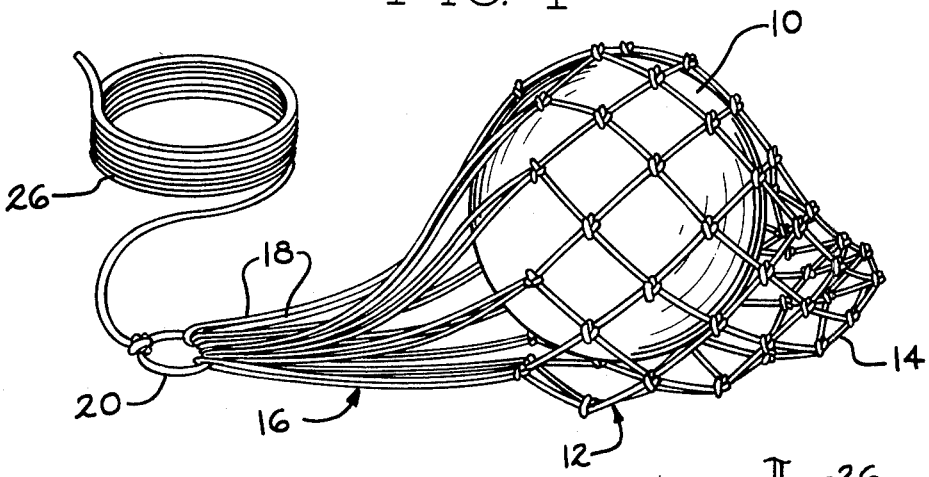
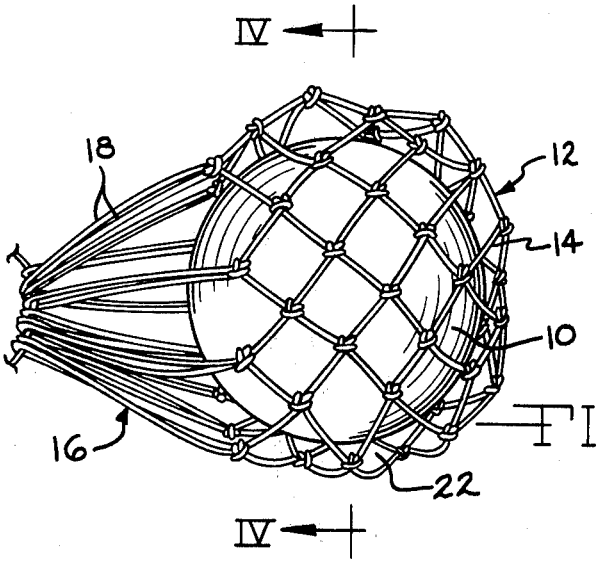
FIG. 2
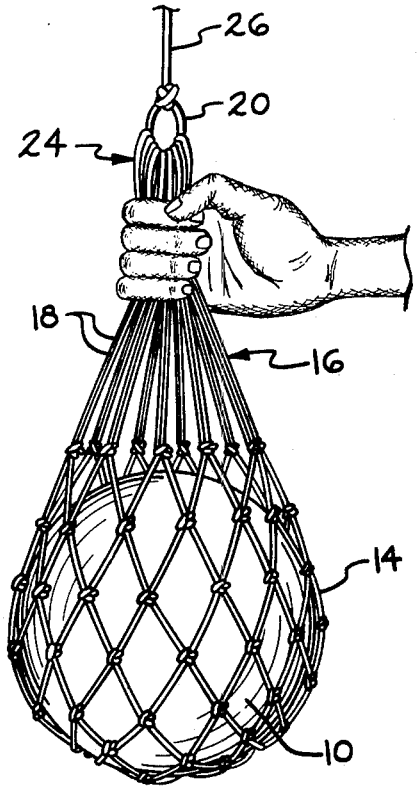
FIG. 3
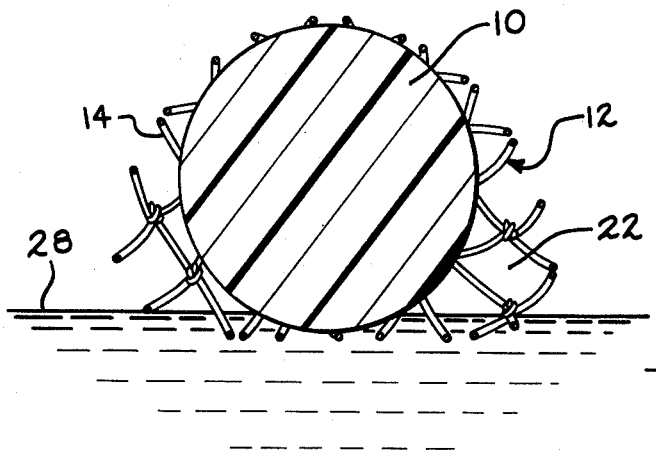
FIG. 4

BUOYANT LIFE-SAVING DEVICE

This is a continuation of application Ser. No. 631,510, filed Nov. 13, 1975, now abandoned.

BACKGROUND OF THE INVENTION

The invention pertains to buoyant life-saving devices of the type adapted to be thrown to a swimmer requiring aid.

Life-saving devices such as rings and floats are frequently carried upon watercraft and located at beaches and swimming pools for the purpose of aiding swimmers encountering difficulty. Such life-saving devices normally consist of a buoyant member adapted to be grasped by the swimmer. The buoyant members often include means defined thereon, such as handles or ropes, which may be easily grasped.

The most common type of life-saver of the aforementioned type is of a flattened ring configuration often having rope handles affixed to the periphery thereof. The device is usually employed by throwing the same in the vicinity of the swimmer but such devices have the disadvantage of being awkward to handle and are difficult to accurately throw and, when thrown a considerable distance, have a tendency to "kite" or sail, making it very difficult to accurately throw the life-saver in the desired direction.

This type of life-saver also has the disadvantage of being relatively difficult to grasp, particularly by children, as the handles are not readily grasped and ones arm must usually be inserted over the life-saver body through the inner hole and in the state of panic or hysteria of many swimmers encountering difficulty, the effective grasping of the life-saver is uncertain. Also such devices are rigid and hard and may strike and injure the swimmer.

Several life-saver constructions are known which use a loose web with a buoyant member, such as shown in U.S. Pat. Nos. 2,817,860; 3,176,327 and 3,421,165. However, these devices do not overcome all the aforementioned problems.

British Pat. No. 207,758 also discloses a life-saver constituting a buoyant ball having rope arms to facilitate grasping and while this device may be thrown relatively accurately, grasping is somewhat difficult and deficiencies are present.

SUMMARY OF THE INVENTION

It is an object of the invention to provide a life-saving device which may be readily thrown in an accurate manner, is safe to use, and may be readily grasped by small children, as well as adults.

A further object of the invention is to provide an economical buoyant life-saving device which does not "kite" or sail when thrown through the air and which would not injure the swimmer if struck thereby during deployment.

In the practice of the invention, a buoyant member, preferably formed of a closed cell cured foam material, is surrounded by a loose envelope defined by a web having an open-mesh configuration.

The web loosely surrounds the buoyant member so that the web may be readily grasped and the web is preferably formed of a buoyant material, such as nylon or polypropylene, so that the web itself contributes to the buoyancy of the life-saving device and the web will tend to spread out on the water adjacent the buoyant member to facilitate grasping.

The web also includes elongated strands which define a handle when the device is suspended from the hand and this "handle" facilitates accurate throwing and permits a "sling"-type throw to be used capable of achieving a greater distance than if a sling-type throw is not utilized.

Retrieving means in the form of a flexible buoyant rope is preferably attached to the web so that the swimmer may be pulled to safety once the web is grasped.

BRIEF DESCRIPTION OF THE DRAWINGS

The aforementioned objects and advantages of the invention will be appreciated from the following description and accompanying drawings wherein:

FIG. 1 is an elevational view of a life-saving device in accord with the invention with the web disposed in a typical manner with the device supported upon a flat hard surface, FIG. 2 is a top view of the device as supported upon the water, FIG. 3 illustrates the device as held by the hand preparatory to throwing, and FIG. 4 is an elevational sectional view of the device with the web supported in the water, as taken along section IV-IV of FIG. 2.

DESCRIPTION OF THE PREFERRED EMBODIMENT

The life-saving device in accord with the invention basically includes a buoyant member 10 loosely confined within an open web 12.

The buoyant member 10 may take a variety of forms, for instance it could be of square, rectangular, oval or oblong configuration but is preferably of a spherical form, as illustrated. The member 10 is buoyant and preferably formed of a closed cell synthetic foam material wherein the foam hardens to a resilient form after activating wherein the resultant material is of a resilient characteristic and may have a relatively high density skin coating, such as a vinyl lacquer, substantially impervious to water penetration. Such buoyant materials include that sold under the Uniroyal Corporation Trademark ENSOLITE, Type M, and acceptable materials are well known in the marine arts having excellent flotation characteristics, durability and resistance to deterioration during repeated immersion in salt or fresh water.

The diameter of the member 10 must be sufficient, with respect to the density and buoyancy of the member material, to provide adequate flotation and buoyancy for life-saving purposes. For instance, a sphere of approximately one foot in diameter is acceptable in most instances. Also, it is significant that the member have sufficient weight to permit the life-saving device to be thrown a reasonable distance and, thus, the member 10 should not be of such a light weight material as to render throwing difficult. It is appreciated that the member may consist of a hollow sphere of metal or plastic material and need not be formed of a closed cell foam material.

The buoyant member 10 is surrounded by a web 12. The web 12 preferably includes a mesh portion 14 and a strand portion 16, the strands 18 being connected to a loop or ring 20. The web is preferably formed of a strong buoyant material, such as nylon or polypropylene, and the strands of the portion 14 are knotted to define evenly spaced mesh openings 22 of sufficient dimension to readily permit the swimmer to insert his fingers therethrough.

The strands 18 are of such length as to define a handle portion 24 of the web when grasped, as shown in FIG. 3. However, the length of the strands 18 is not sufficient to permit the buoyant member 10 to be able to pass therebetween.

The ring 20 may be formed of the same material as the web and strands, or could be of a rigid plastic or of metal. Preferably, a retrieval rope 26 of a buoyant material, such as polypropylene or nylon, is attached to the ring 20. However, it will be understood that the device will function for buoyancy in life-saving purposes without the rope 26.

The dimension of the member 10 with respect to the dimension of the envelope defined by the web 12 is such that the web loosely surrounds the member but is not so loose as to be ineffective to support a swimmer grasping the web. When the device rests upon a hard surface, such as a table top, the web will be disposed about the member 10 in a manner as shown in FIG. 1. When the life-saving device rests upon the water the web will be disposed about the member in a manner similar to that shown in FIGS. 2 and 4. Under these circumstances, the upper portion of the web will be directly engaging the upper portion of the buoyant member 10 and the portions of the web 12 adjacent the water surface 28 not immediately below the member 10 will tend to float and bow outwardly and space themselves from the wall of the member 10. That portion of the web directly below the member will engage the bottom of the member, FIG. 4.

As will be appreciated from FIG. 4, with the mesh 12 deployed about the member 10 in the manner illustrated, sufficient spacing exists between the mesh and the member adjacent the water surface 28 to readily permit the swimmer to grasp the web. A swimmer fearful of drowning may be near hysteria, threshing his arms, and once the life-saving device is within his grasp the lunging at the device with the fingers will usually result in the fingers passing through the web and the swimmer will then be able to effectively hang onto the device.

As the configuration of the web permits the member 10 to be "suspended" below the location of the strands 18 when the device is lifted, the pendulum effect permits the device to form a type of sling capable of being thrown a greater distance than if the member 10 were thrown as a baseball. The device may be thrown either underhand or with an overhand motion and the uniform shape of the member 10 prevents kiting or sailing and the device may be accurately thrown without adverse aerodynamic effects created by the shape of the device. Further, as the web and member are relatively soft the swimmer, if struck, will not be injured.

Preferably, the rope 26 is affixed to the ring 20 wherein the swimmer may be pulled to the pool edge, shore or boat, once the device is grasped and, in most instances, the device will not be used without the rope. However, the buoyancy of the member 10 is sufficient to permit the swimmer to maintain his head above water and the fact that the web may be easily grasped substantially eliminates the likelihood of the swimmer losing his grip upon the device.

It is appreciated that various modifications to the invention may be apparent to those skilled in the art without departing from the spirit and scope of the invention.

I claim:

1. A life-saving device having, in combination, a sole buoyant member of sufficient weight to permit being thrown, and a flexible net-like web envelope surrounding and confining said buoyant member, said web being formed of a buoyant material and having openings of sufficient dimension to permit said web to be readily grasped through said openings, said web envelope being substantially larger than said buoyant member but small enough to effectively support a swimmer when the net is grasped whereby said web envelope is loosely disposed about said buoyant member when said member is floating permitting said web to float and spread away from said member on the surface of the water to facilitate grasping by a swimmer.

2. In a life-saving device as in claim 1 wherein said web is formed of nylon.

3. In a life-saving device as in claim 1, flexible retrieval means comprising a buoyant rope attached to said web.

4. In a life-saving device as in claim 1 wherein said web includes a plurality of elongated nonmeshed strands defining a grasping portion for throwing.

5. In a life-saving device as in claim 1 wherein said buoyant member is formed of a synthetic closed cell foamed material.

6. In a life-saving device as in claim 1 wherein said buoyant member comprises a single member of a spherical configuration.

* * * * *